US005924911A

United States Patent [19]

Brålander

[11] Patent Number: 5,924,911

[45] Date of Patent: Jul. 20, 1999

[54] ARRANGEMENT FOR GRINDING OF PREFERABLY SLABS AND METHOD

[75] Inventor: Börje Brålander, Stenungsund, Sweden

[73] Assignee: Danieli Centro Maskin SpA, Pradamano, Italy

[21] Appl. No.: 08/860,901

[22] PCT Filed: Jan. 12, 1996

[86] PCT No.: PCT/SE96/00020

§ 371 Date: Aug. 26, 1997

§ 102(e) Date: Aug. 26, 1997

[87] PCT Pub. No.: WO96/22173

PCT Pub. Date: Jul. 25, 1996

[30] Foreign Application Priority Data

Jan. 16, 1995 [SE] Sweden ..... 9500116

[51] Int. Cl.[6] ..... B24B 49/02; B24B 1/00; B24B 7/12

[52] U.S. Cl. ..... 451/5; 451/8; 451/11; 451/49; 451/57; 451/65; 451/130; 451/150; 451/213

[58] Field of Search ..... 451/5, 8, 11, 49, 451/57, 65, 124, 130, 131, 150, 167, 172, 213, 336

[56] References Cited

U.S. PATENT DOCUMENTS

| | | | |
|---|---|---|---|
| 2,907,151 | 10/1959 | Peterson | 451/57 X |
| 3,503,161 | 3/1970 | Long | 451/57 |
| 4,461,124 | 7/1984 | Anderson | 451/336 X |
| 4,837,984 | 6/1989 | David | 451/57 |
| 5,276,999 | 1/1994 | Bando | 451/336 X |
| 5,361,544 | 11/1994 | Yang | 451/57 X |

*Primary Examiner*—Timothy V. Eley
*Attorney, Agent, or Firm*—Antonelli, Terry, Stout & Kraus, LLP

[57] ABSTRACT

The invention relates to a method for grinding of preferably billets, blooms or slabs which are moved in a certain direction on a support. The method means that the grinding is performed in a track which is perpendicular to the travel direction of the billets, blooms or slabs. The invention also relates to an arrangement for performing the method, which arrangement is characterized in that the means carrying the grinding wheel is arranged on a table (14) which is moveable forward and backward in the travel direction of the billets, blooms or slabs (1), which table (14) in its turn is arranged on a frame or the like (16) which is moveable forward and backward in a direction which is perpendicular to the travel direction of the billets, blooms or slabs.

7 Claims, 2 Drawing Sheets

ARRANGEMENT FOR GRINDING OF PREFERABLY SLABS AND METHOD

TECHNICAL FIELD

The present invention relates to an arrangement and a method for grinding articles such as billets, blooms and slabs which are moved in a certain direction on a support.

PRIOR ART

Grinding of different articles is a very ancient treatment method and an indefinitely great number of means for the performance of such methods have been constructed. The grinding is performed to give an article, for example, an accurate dimension, an attractive surface, a specially-shaped surface, a surface with grooves, etc. A certain grinding method is known for grinding steel billets, blooms or slabs which, after grinding, shall be milled out to plates or the like. To achieve a successful milling it is necessary that the surface of the billet, bloom or slab which is introduced into the mill is free from impurities, scratches and the like. Special plants for such billet grinding have been constructed. They are often connected to a moulding plant for continuous moulding of billets which, in a warm condition, are introduced into the grinding arrangement. Also grinding of cool billets may occur.

In the known billet grinding plants the billet to be ground is moved forwards and backwards on a support while the rotating grinding wheel, which is arranged on the end of an arm, is given a stationary position. When the billet has been ground forward to one end, the grinding wheel is moved relative to the billet and the billet is ground along a new grinding track adjacent to the earlier grinding track by moving the billet in an opposite direction. Two or more grinding tracks adjacent to each other are accordingly made. Due to the fact that the grinding wheel rotates in a plane perpendicular to the movement direction of the billet and that it is cylinder-shaped on its surface, the adjacent grinding tracks will then be somewhat arc-formed. This can be changed by bringing the grinding wheel to rotate in a plane which has an angle of 45° in relation to the forward direction of the billet at the last grinding.

Billets which are rectangular or square in section are advantageously ground on two opposite sides. Preferably, two grinders are then used and a turning device is then used between the two grinders.

Methods and arrangements for grinding the billets crosswise are also known. Such a method and arrangement are described in, for example, the European patent 0 053 274, which method includes moving the grinding disc across the forwardly moving billet at such an angle compared to the billet that the ground area will have an angle of 90° compared to the longitudinal direction of the billet. In such an arrangement the grinding wheel must be swingable so that it is moved forward at an angle compared to the billet when it is moved forward different than the angle when it is moved backwards. The billet will also receive a grinding of low quality since the grinding traces will be oblique.

Another method and another arrangement are described in the German patent 3 037 571 wherein the billet is ground on both the underside and the upper side. The grinding wheels are in this case stationary with the exception that they can be moved forwards and backwards across the billet.

A further arrangement for grinding billets is described in the British patent 2 223 432, which arrangement comprises a grinding wheel which goes across the billet. In such a case it is important that the billet does not move quicker than the width of the grinding wheel. If it does, the whole surface will not be ground.

TECHNICAL PROBLEM

Although grinding of billets, blooms and slabs with the known technique and the known machines may give satisfying results, the grinding will be discontinuous and complicated as the billet has to be moved forward and backward a number of times so that the whole surface shall be ground. Moreover, an arc-shaped surface is obtained by grinding more parallel tracks, which surface must be made even in a last step by using in this step a grinding wheel which is arranged at an angle of 45° to the forward direction of the billet.

When grinding is made crosswise of the billet, poor quality of the grinding is usually obtained and complicated machines having swingable grinding wheels must in many cases be used. This gives unsatisfactory results and high investment costs.

THE SOLUTION

It has therefore long been a desire to be able to bring about an even grinding surface by only one penetration of the billet in the grinding machine, which however may comprise more grinding wheels, and an arrangement has therefore been brought about according to the invention for grinding of preferably billets, blooms or slabs which are moved in a certain direction on a support comprising a support for the billets, blooms or slabs which are to be ground and means for driving and guiding the billets, blooms or slabs on the support, which arrangement is characterized in that the carrying means of the grinding wheel is arranged on a table which is movable forward and backward in relation to the movement direction of the billet, bloom or slab which table in its turn is arranged on a frame which is movable forward and backward across the movement direction of the billet, bloom or slab.

According to the invention it is suitable that the table is displaceably mounted on two parallel shafts running in the moving direction of the billets and removed from each other, which shafts are fastened in the frame or the like.

According to the invention the frame should be arranged to, preferably by means of wheels, roll or slide on rails which are located perpendicularly to the movement direction of the billets.

Several separate grinding wheels, preferably 4, may according to the invention be arranged after each other in the movement direction of the billet.

According to the invention, when four grinding wheels are used the first two can be intended for rough grinding and the latter two for fine grinding.

According to the invention it is suitable that a gauge for measuring temperatures and dimensions of the billet is arranged at the entrance of the grinding arrangement.

According to the invention the arrangement should be controlled automatically by means of a computer system.

Two identical arrangements with an intermediate turning device should, according to the invention, be arranged after each other for grinding of two opposite sides.

The invention comprises also a method for grinding of preferably billets, blooms and slabs which are moved in a certain direction on a support whereby the grinding is carried out in a track which is perpendicular to the movement direction of the billet, bloom or slab and the forward and backward movements of the grinding wheel which brings about the grinding in the track during the grinding has a direction which is oblique compared to the movement direction of the billet, bloom or slab and which is characterised in that the movement direction of the grinding wheel is composed of one movement direction which is perpendicular to the movement direction of the billet, bloom or slab and one movement direction which is parallel to the movement direction of the billet, bloom or slab.

The speed in the movement direction which is parallel with the movement direction of the billet is, according to the invention, equal to the speed of the billet in its movement direction.

The grinding wheel should, according to the invention, rotate in a plane which has an angle of from 90° to 45° to the movement direction of the billet.

According to the invention the grinding may be carried out in several steps, for example four, and the first steps, for example the first two, may be carried out as rough grinding while the succeeding steps are carried out as fine grinding.

BRIEF DESCRIPTION OF THE DRAWINGS

In the following the invention will be described more in detail in connection with the attached drawings where FIG. 1 schematically shows a complete grinding arrangement according to the invention seen from above.

DETAILED DESCRIPTION OF PREFERRED EMBODIMENT

Figure 1:
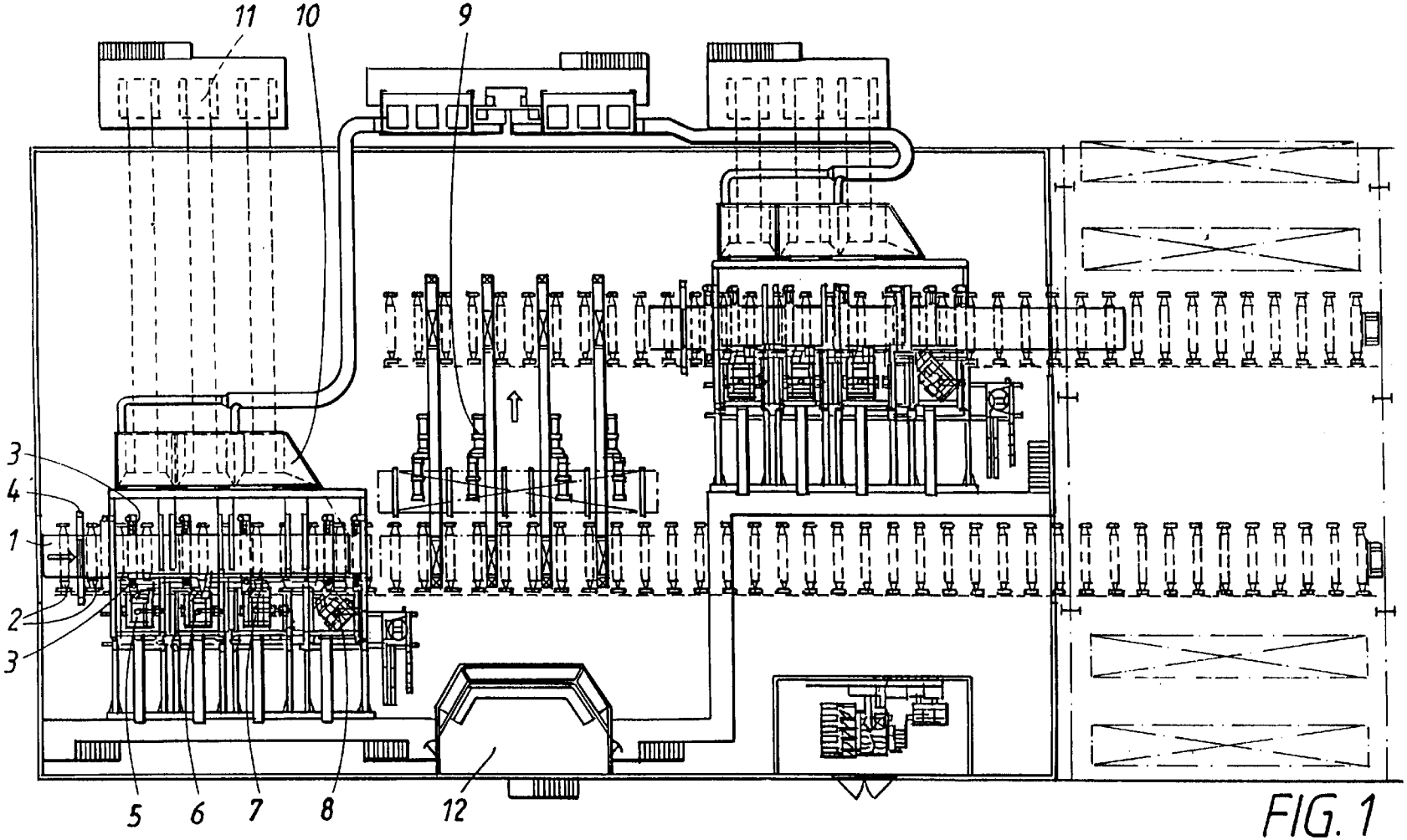

FIG. 1 shows a plant for preferably billet grinding which can have a direct connection to a plant for continuous moulding of billets. These billets 1, which have been cut in suitable lengths, are introduced on a roller track 2 which consists of parallel easily moveable rolls in a number which is adapted to the size of the plant. For sideward guidance of the billet 1, vertical rolls 3 have been arranged. The temperature and dimensions of the billet 1 are measured by the gauge 4 of a per se known kind at the entrance of the grinding machine.

In the present embodiment, four grinding units 5, 6, 7 and 8 have been arranged after each other. The grinding units 5 and 6 are so arranged that the grinding wheel rotates in a plane which has an angle of 70° to the travel direction of the billet 8. The last grinding unit 1 is, however, arranged so that the grinding wheel rotates in a plane which has an angle of 45° to the travel direction of the billet 1.

When the billet 1 leaves the last grinding unit 8 it enters a section of the roller track which cooperates with a turning arrangement of known kind which lifts the billet over to a new track and simultaneously turns the billet upside down compared to the original position. The turning arrangement 9 is of a conventional kind and will not be described further here. When the billet 1 has been arranged on the new track it is ground in a new grinding arrangement which is identical to the first one so that the billet will be ground on two opposite sides. Thereafter, the billet 1 leaves the grinding plant on a free roller track and it is then removed for further treatment, for example milling.

The arrangement also comprises a dust remover 10 and a dust collector 11.

The whole arrangement is adapted for computer control whereby the computer and the operator are located in a separate space 12.

Figure 2:
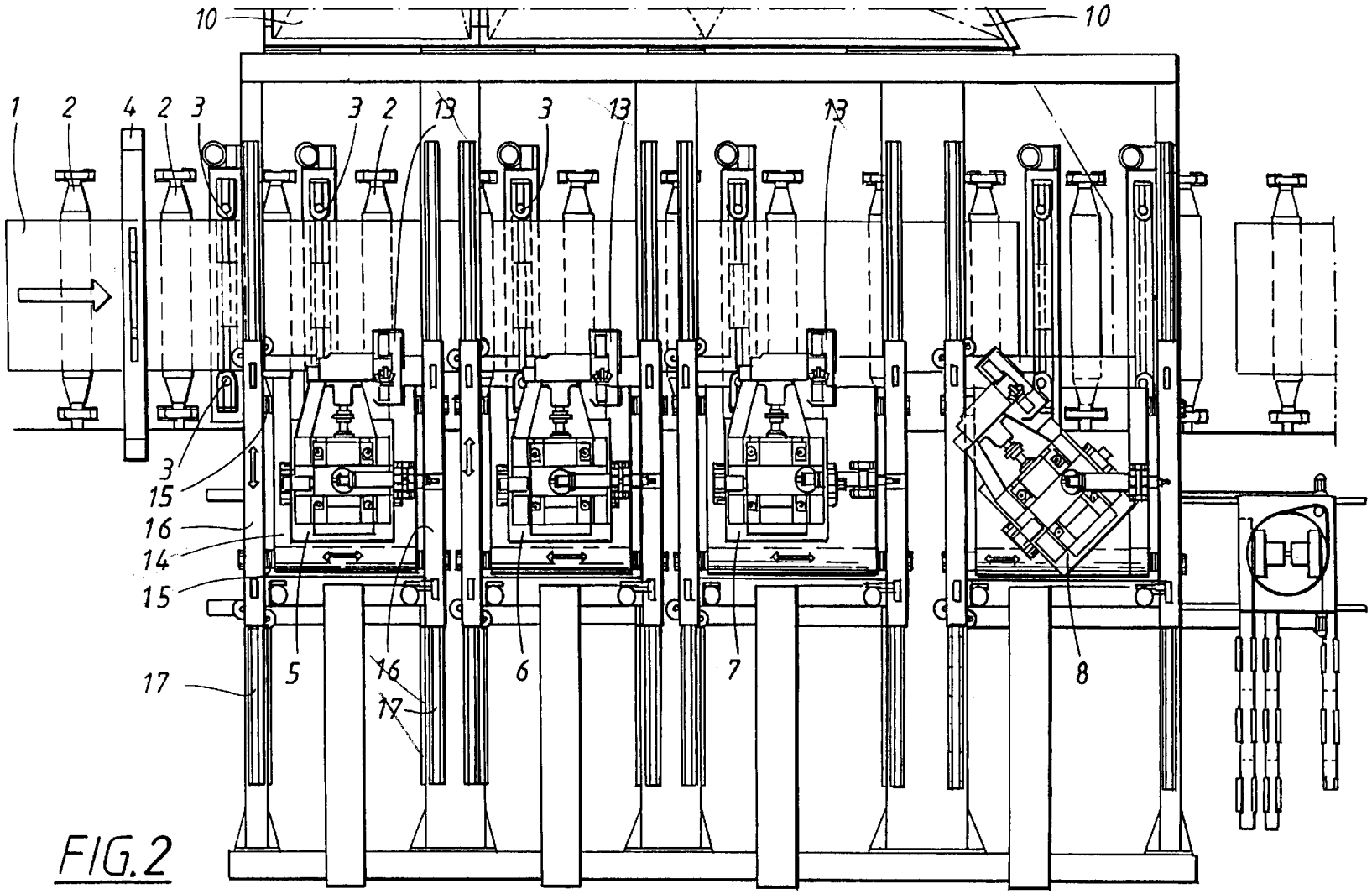
FIG. 2 in a larger scale, shows the more important part of the present invention seen from above, i.e., that part of the arrangement which is shown at the bottom left of FIG. 1.

FIG. 2 shows in an enlarged scale how the grinding units 5, 6, 7 and 8 are constructed and arranged. All units are the same but units 7 and 8 are turned at an angle of 45° compared to the travel direction of the billet. The grinding wheel 13 of each unit, which rotates in a plane perpendicular to the travel direction of the billet 1 is arranged on an arm in a conventional way and is driven by an electric motor. The grinding wheel arrangement is anchored to a table 14 which in its turn is slidably mounted on two shafts 15. The table 14 can then be moved on these shafts 15 in the same direction as the billet 1 is moved. The speed of this movement is the same as that with which the billet is moved.

The shafts 15 are in their turn fastened to a frame 16 which in its turn can glide on rails 17 perpendicular to the travel direction of the billet 1. During grinding, the grinding wheel can consequently grind a track crosswise of the billet 1. When the grinding wheel 13 has come to the other side of the billet 1 it is displaced one step which is equal to its own thickness backwards in the travel direction of the billet 1 and it will now grind a new grinding track which is parallel to the first one during the return movement.

The first two grinding units 5 and 6 may be units for rough grinding and the latter 7 and 8 units for fine grinding. A maximal grinding depth of 1.5 mm is suitable when the billet 1 is moved forward at a speed of 1.5 m per minute. The final fineness of the surface may suitably be 60 $\mu$m Rt. This means that every rough grinding unit grinds to a grinding depth of 0.6 mm and every fine grinding unit to a grinding depth of 0.15 mm.

Exchange of grinding wheels suitably occurs, according to the invention, by a wheel exchanging manipulator. The guiding system keeps track of the wheel diameters and will indicate when a wheel is to be exchanged on suitable occasions. The wheel exchange occurs automatically and completely without manual action. During the wheel exchange the frame 16 is displaced completely backwards on the rail 17.

If a grinding wheel is to be exchanged during grinding, two of the three first grinding units will then compensate for the lack of one grinding unit during the time when the wheel exchange occurs.

The grinding arrangement can, as stated above, be wholly automatic and the grinding can be performed without any operator. The arrangement is conducted by, for example, a VAX 60 computer having a database for grinding programs, production reports and planned maintenance. Control of machine functions, alarm control and parameter display is, for example, shown on a PC monitor. The grinding arrangement can suitably also include a vibration monitoring system for vital parts such as grinding spindles and hydraulic pumps. If a vibration level is exceeded an alarm signal is received with calculated remaining operation time before exchange or repair has to be done.

As appears from FIG. 1, also a roller track arrangement is included in the travel direction of the grinding billet 1 after the turning device. Thus, it is possible according to the invention to grind only one side or, if the grinding wheels are lifted from the billet l, to let the billets pass directly through the grinding arrangement without any treatment.

By means of the present invention it is accordingly possible to grind billets continuously and on two opposing sides without any forward and backward movement of the grinding billet. This means, of course, a substantial rationalisation and time gain for the grinding.

According to the invention, it is also possible to grind billets, blooms or slabs which have not been cut and which come directly from a plant for continuous moulding. In such a case, it is possible to modify the grinding arrangement so that grinding can be also be carried out from the underside of the billet, i.e. on two opposing sides, without turning the billet, bloom or slab.

The invention is not limited to the embodiment example shown but can be varied in different ways within the scope of the claims.

I claim:

1. Method for grinding of articles which are moved in a certain direction on a support, whereby the grinding is performed in a track which is perpendicular to the travel direction of the articles and the forward and backward movement of the grinding wheel in the track during grinding has a direction which is oblique compared to the travel direction of the articles, wherein the movement direction of the grinding wheel is composed of one movement direction which is perpendicular to the travel direction of the articles and one movement direction which is parallel to the travel direction of the articles and wherein the grinding is performed in several steps, and that the first steps are performed as rough grinding whereas the succeeding steps are performed as fine grinding.

2. Method according to claim 1, characterized in that the speed in the movement direction which is parallel with the travel direction of the articles is equal to the speed of the articles in their travel direction.

3. Method according to claim 1, characterized in that the grinding wheel rotates in a plane which has an angle between 90 and 45 degrees to the travel direction of the articles.

4. Arrangement for grinding of articles which are moved in a certain direction on a support comprising a support for the articles which are to be ground and means for driving and guiding the articles on the support, wherein means for carrying the grinding wheel are arranged on a table which is movable forward and backward in a direction of travel for the articles, which table in its turn is arranged on a frame which is movable forward and backward in a direction perpendicular to the movement direction of the article, the arrangement being characterized in that it includes:

a gauge for measuring temperature and dimension of the articles at the entrance of the grinding arrangement, several separate grinding wheels which are arranged after each other in the travel direction of the articles, two identical arrangements with an intermediate turning device which are arranged after each other for grinding of two opposing sides, a computer system to automatically control the arrangement.

5. Arrangement according to claim 4, characterized in that the table is displaceably mounted on two parallel shafts running in the direction of travel for the articles, which shafts are at a distance from each other and are fastened to the frame.

6. Arrangement according to claim 4, characterized in that the frame is arranged to roll or glide by means of wheels on rails which are arranged perpendicularly to the movement direction of the articles (1).

7. Arrangement according to claim 4, wherein four grinding wheels are provided, the two first grinding wheels being intended for rough grinding and the two later wheels for fine grinding.

* * * * *